US005425474A

United States Patent [19]

Dalea et al.

[11] Patent Number: 5,425,474

[45] Date of Patent: Jun. 20, 1995

[54] CEREAL BOWL SHIPPING AND DISPENSING PACKAGE

[75] Inventors: Gregory P. Dalea, Maple Grove; Bruce A. Peik, St. Louis Park, both of Minn.

[73] Assignee: General Mills, Inc., Minneapolis, Minn.

[21] Appl. No.: 215,549

[22] Filed: Mar. 22, 1994

[51] Int. Cl.[6] ..... A47F 1/08

[52] U.S. Cl. ..... 221/305; 221/306; 221/194; 221/283; 206/499; 206/526; 206/45.12; 229/122.1

[58] Field of Search ..... 221/305, 306, 22, 191, 221/194, 283; 186/52; 206/499, 526, 553, 45.12, 44.12; 229/122.1

[56] References Cited

U.S. PATENT DOCUMENTS

| | | | |
|---|---|---|---|
| D. 208,671 | 9/1967 | Lang | D9/341 |
| D. 263,354 | 3/1982 | Jones | D7/589 X |
| D. 321,134 | 10/1991 | Toinet | D9/415 |
| D. 333,781 | 3/1993 | Kobel | D9/339 |
| D. 335,242 | 5/1993 | Saunders . | |
| 902,347 | 10/1908 | Tillinghast . | |
| 1,292,463 | 1/1919 | Hayashi . | |
| 1,341,893 | 6/1920 | Fitz Gerald . | |
| 1,412,547 | 4/1922 | Weymuth | 229/122.1 |
| 1,725,372 | 8/1929 | Richman . | |
| 1,875,781 | 9/1932 | Turner | 229/122.1 X |
| 1,898,056 | 2/1933 | Johnson . | |
| 1,956,642 | 5/1934 | Einson . | |
| 1,959,231 | 5/1934 | Dube . | |
| 2,005,924 | 6/1935 | Wilson . | |

(List continued on next page.)

FOREIGN PATENT DOCUMENTS

| | | | |
|---|---|---|---|
| 240681 | 9/1962 | Australia | 229/122.1 X |
| 873185 | 6/1971 | Canada | 229/122.1 X |
| 0373746 | 6/1990 | European Pat. Off. . | |
| 373746 | 6/1990 | European Pat. Off. | 229/122.1 X |
| 2288689 | 5/1976 | France . | |
| 2268159 | 1/1994 | United Kingdom | 229/122.1 X |

OTHER PUBLICATIONS

Modern Packaging, Dec. 1975, p. 64, as circled.
Packaging catalog, 1941, p. 47, as circled.

*Primary Examiner*—James R. Bidwell
*Assistant Examiner*—Dean A. Reichard
*Attorney, Agent, or Firm*—L. MeRoy Lillehaugen; John A. O'Toole; Alan D. Kamrath

[57] ABSTRACT

A package (10) is disclosed including a dispensing carton (12) containing a stack of covered bowls (54) holding ready-to-eat breakfast cereal. The carton (12) includes a removable tab (64) including an upper, linear, perforated line (66) and a lower, linear, perforated line (68) spaced from and parallel to the bottom edge (44) of the front panel (18). The side panels (24, 32) of the carton (12) each include a cut, arcuate line (70) extending from the upper line (66) and a linear, perforated line (72) parallel to its bottom edge (40) and extending from the arcuate line (70) to the corner between the front panel (18) and the side panel (24, 32). The front panel (18) further includes first and second cut lines (74) extending from the linear lines (72) of the side panels (24, 32) to the opposite ends of the lower line (68) which are spaced from the corners between the front panel (18) and the side panels (24, 32). The lengths of the uncut portions are generally equal to the lengths of the cut portions in the perforated lines (72) of the side panels (24, 32) and are substantially shorter than the lengths of the cut portions in the perforated lines (66, 68) of the front panel (18). The rims (58) of the bowls (54) in the preferred form shown each include a radial ear (60) which extends in one of the corners between the front and side panels (18, 24, 32) to prevent rotation of the bowls (54) in the carton (12). The ear (60) of the individual bowl (54) to be dispensed can be rotated to extend through the dispensing opening and beyond the front panel (18).

25 Claims, 3 Drawing Sheets

U.S. PATENT DOCUMENTS 2,067,749 1/1937 Zimmerman et al. .
2,104,523 1/1938 Lichtenstein .
2,339,383 1/1944 Davidson ..... 221/305 X
2,706,066 4/1955 Wells .
2,875,938 3/1959 Bramhill .
3,014,634 12/1961 Humphrey et al. ..... 229/122.1 X
3,121,511 2/1964 Whitehead .
3,265,283 8/1966 Farquhar .
3,300,115 1/1967 Schauer ..... 221/305
3,356,279 12/1967 Root .
3,586,206 6/1971 Gilmore et al. .
4,169,542 10/1979 Miller .
4,170,325 10/1979 Pawlowski et al. .
4,199,078 4/1980 Ramirez .
4,405,044 9/1983 Flower et al. .
4,739,922 4/1988 Zimmermann .
5,143,252 9/1992 Shi .

CEREAL BOWL SHIPPING AND DISPENSING PACKAGE

BACKGROUND

The present invention generally relates to shipping and dispensing packages, particularly to shipping and dispensing packages for bowls, more particularly to shipping and dispensing packages for bowls containing non-perishable food, and specifically to shipping and dispensing packages for bowls containing ready-to-eat cereal, savory/sweet snacks, or the like.

For a variety of reasons, people often eat breakfast on the run. Specifically, one or more food items are often purchased at a convenience store and then eaten away from home such as at an office. Often the food items purchased are donuts, rolls, candy bars, and the like which are not very healthy or nutritious. Although ready-to-eat cereal is a staple of most breakfasts eaten at home, ready-to-eat cereal is typically not consumed outside of a home or a dining establishment such as a restaurant or cafeteria. This is because prior to the present invention, ready-to-eat cereal was not marketed in a manner to be conducive to be eaten on the run. Specifically, although ready-to-eat cereals such as FINGOS brand cereal marketed by General Mills, Inc. exist which are specifically formulated to be eaten with the fingers, most ready-to-eat cereal is conventionally eaten with milk. Although single-serve packages of cereal exist, the cereal conventionally is poured from the package into a bowl for receiving the milk, and bowls may not be readily available when eating on the run. Further, food typically eaten on the run is often an impulse purchase and is placed by convenience stores closely adjacent the check-out counter and/or refrigerated coolers including milk, juice, soda, and the like. Ready-to-eat breakfast cereal is, however, placed in the store at locations which are not as conducive to impulse purchasing to be eaten on the run. Thus, ready-to-eat cereal has not played a major role in the eat-on-the-run food market even though it plays a very important role in conventional dining and is much more nutritious and healthy than typical eat-on-the-run food.

Thus, a need exists for packaging of ready-to-eat cereal which lends itself to be utilized in eat-on-the-run environments. Specifically, such packaging should be in the form of a bowl-type container to allow milk to be simply added thereto with the cereal already present therein. Such packaging should also lend itself for commercialization by convenience stores. Particularly, preferably the packaging should be utilized for containing, shipping, and storing the individual servings of ready-to-eat cereal and also for dispensing the individual servings of ready-to-eat cereal at the store to the consumer. Further, such packaging should be disposable to reduce handling. Likewise, such packaging should be readily mounted and removed at locations which are conducive to impulse purchasing and preferably to vertical walls or surfaces so that valuable shelf space is not required. In particular, placement on or closely adjacent to refrigerated coolers including milk is especially desirable.

SUMMARY

These needs and other problems in the field of marketing ready-to-eat food and especially cereal are solved by providing, in the preferred form of the present invention, packaging for containing, shipping, and dispensing filled bowls of ready-to-eat cereal. Such packaging, in a first aspect of a preferred form of the present invention, includes a dispensed product having an ear extending radially beyond the cylindrical outer surface of the product and into at least one of the corners of a dispenser arranged in a square configuration, with the ears preventing rotation of the product within the dispenser. In the most preferred form, the product can be rotated such that the ear extends through the dispensing opening formed in at least the front panel of the dispenser.

In another aspect of the present invention, the dispensing opening is spaced from the bottom edge of the front panel and includes first and second front panel lines extending from the lower line of the dispensing opening to the corners between the front panel and the first and second side panels, respectively, at points spaced from the bottom edge greater than the spacing of the interconnections of the first and second front panel lines to the lower line from the bottom edge and defining braces adjacent to the first and second corners between the front panel and the first and second side panels to enhance the prevention of the deflection of the dispenser due to the products contained therein.

In still another aspect of the present invention, the dispensing opening is defined by a removable tab formed in the front panel and the first and second side panels and including a lower line formed in the front panel, an upper line formed in the front panel spaced from and parallel to the lower line, and at least first side panel lines formed in the first and second side panels, with the lower and upper lines being linear and parallel to the bottom edge of the front panel, with the first side panel lines, the lower line and the upper line being perforated including cut and uncut portions, with the cut portions of the lower and upper lines being substantially longer than the uncut portions. In the most preferred aspect of the present invention, the cut portions of the first side panel lines have a length substantially equal to the uncut portions.

These and further aspects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where:

FIG. 1 shows a perspective view of a package for containing, shipping, and dispensing filled bowls of ready-to-eat cereal according to the preferred teachings of the present invention, with portions broken away to show constructional details.

Figure 2:
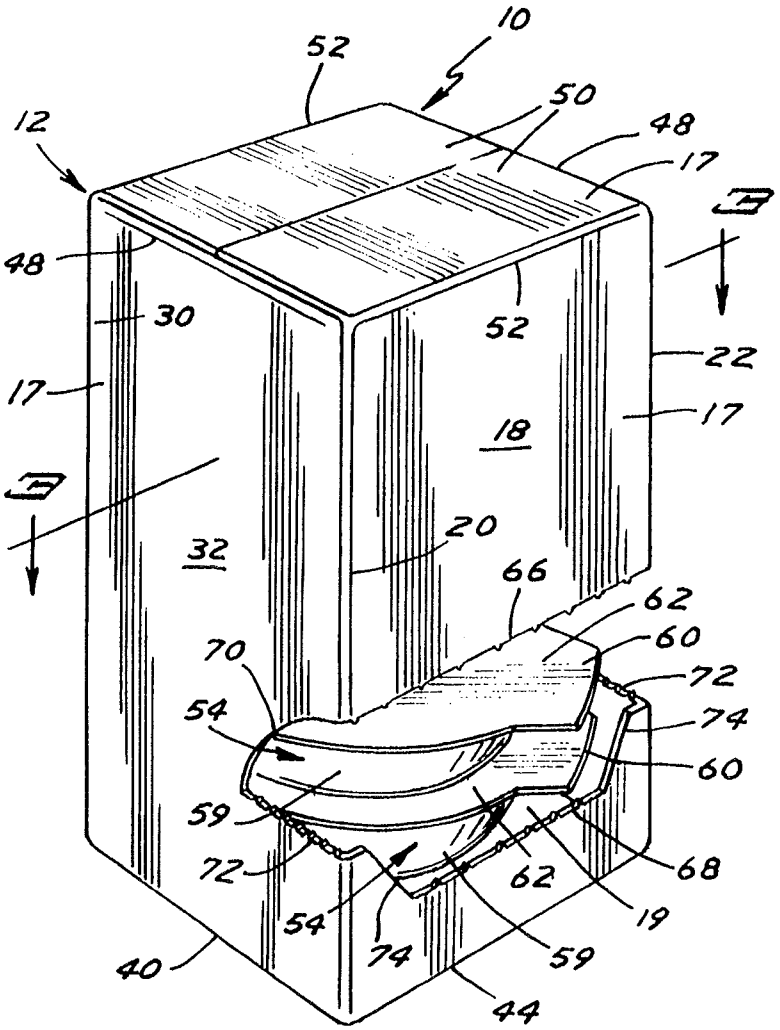
FIG. 2 shows a perspective view of the package of FIG. 1, with the removable tab being removed to form a dispensing opening therein.
Figure 7:
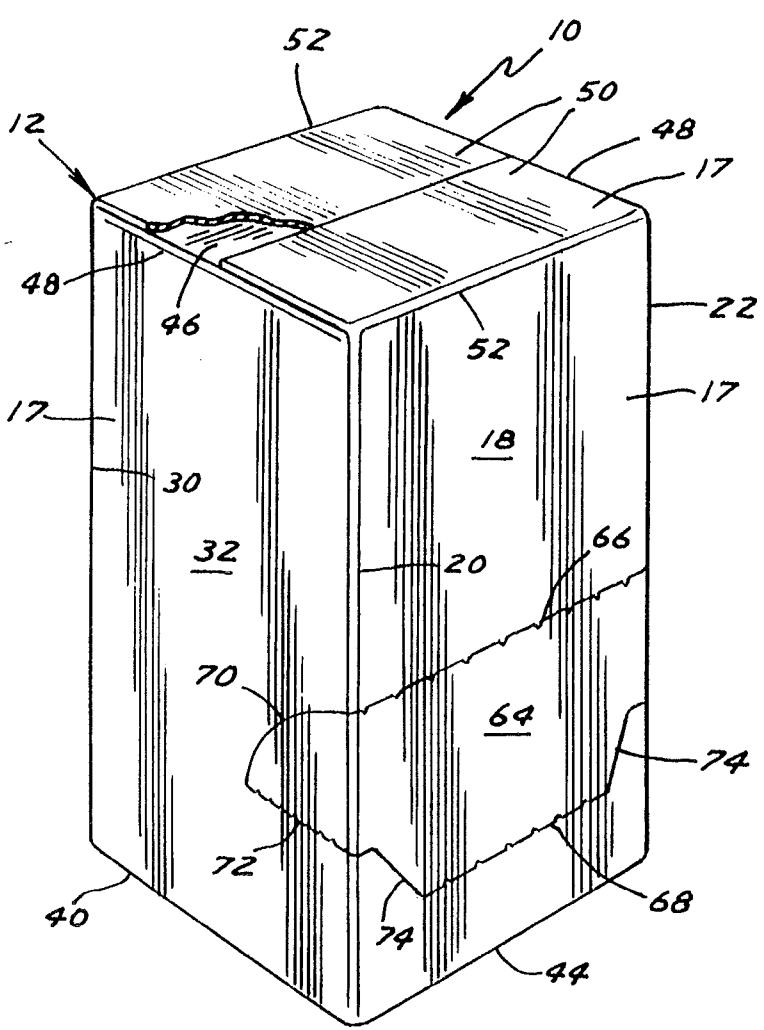
FIG. 7 shows a rear view of the package of FIG. 1.
Figure 3:
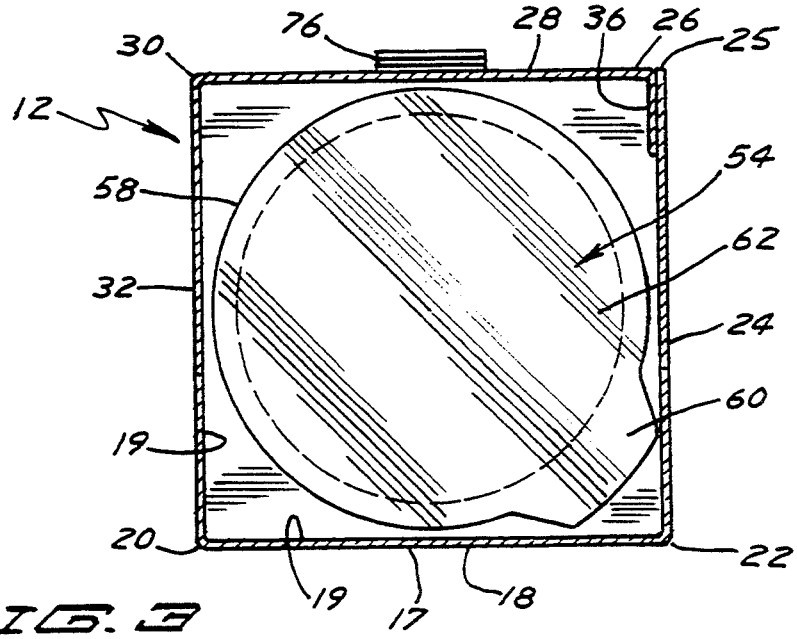
FIG. 3 shows a cross-sectional view of the package of FIG. 1 according to section line 3—3 of FIG. 2.
Figure 4:
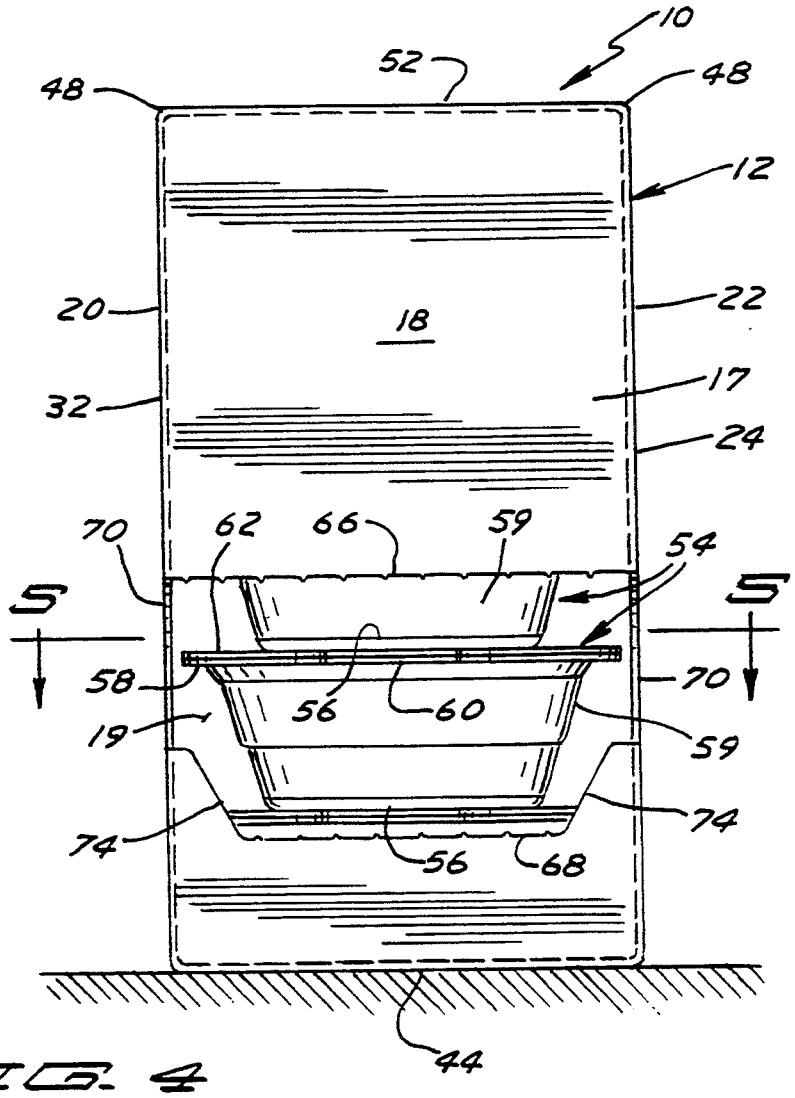
FIG. 4 shows a front view of the package of FIG. 2 with the bowl rotated such that the ear of the bowl extends through the dispensing opening.
Figure 5:
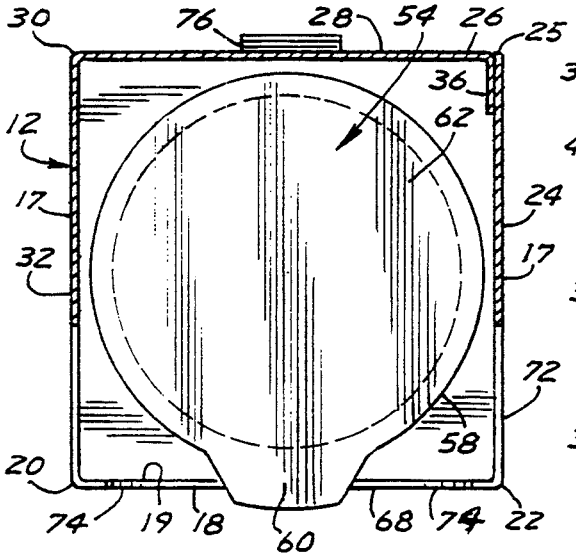
FIG. 5 shows a cross-sectional view of the package of FIG. 4 according to section line 5—5 of FIG. 4.
Figure 6:
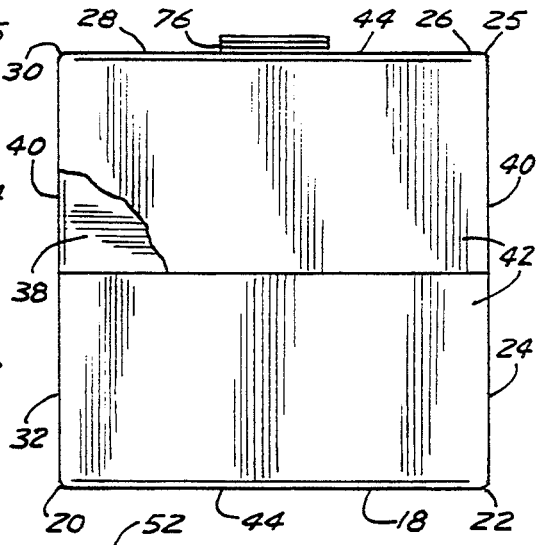
FIG. 6 shows a bottom plan view of the package of FIG. 1, with portions broken away to show constructional details.
Figure 7:
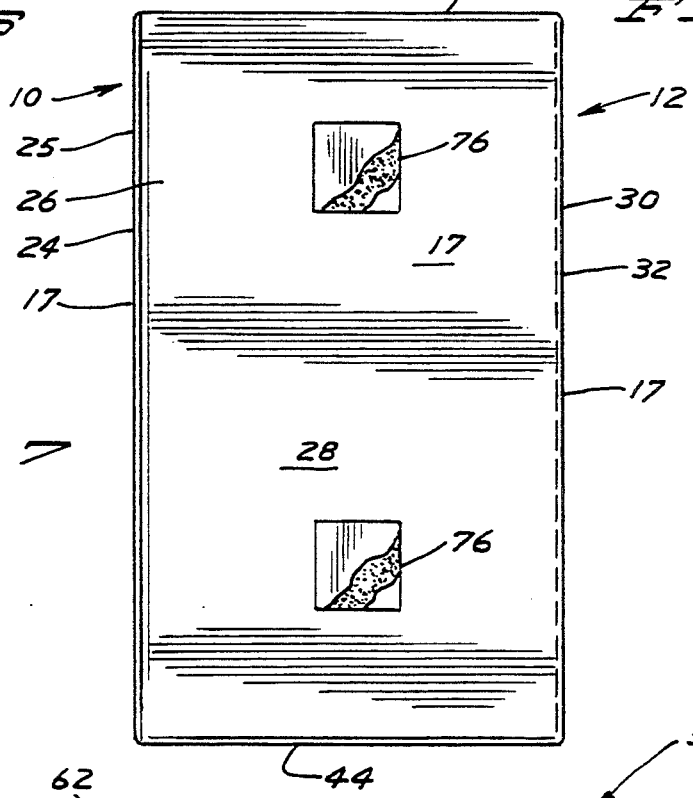
Figure 8:
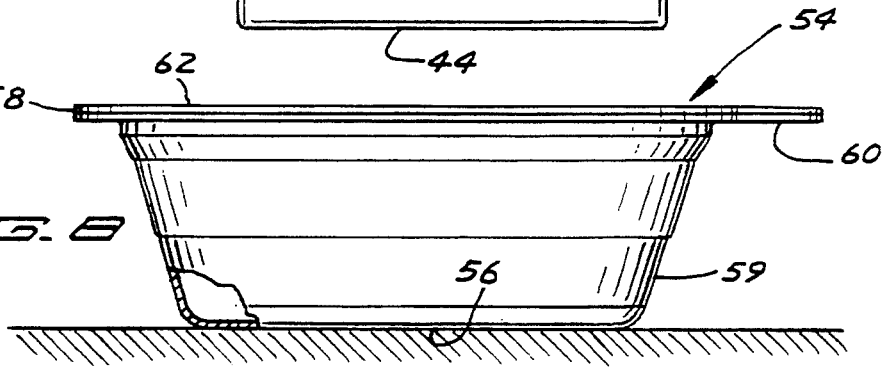
FIG. 8 shows a side view of the bowl contained, shipped, and dispensed by the package of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "edge", "side", "front", "back", "length", "width", "inner", "outer", and similar terms are used herein, it should be understood that these terms have reference only to the structure shown in the drawings as it would appear to a person viewing the drawings and are utilized only to facilitate describing the invention.

DESCRIPTION

A package according to the preferred teachings of the present invention for containing, shipping, and dispensing filled bowls of non-perishable food and particularly ready-to-eat cereal is shown in the drawings and generally designated 10. Generally, package 10 includes a dispenser in the form of a dispensing carton 12. Carton 12 according to the teachings of the present invention is formed from a blank of a single layer of generally stiff material such as paperboard. The blank includes an outer surface 17 which has printed material and an inner surface 19 which is plain and does not include printed material. The blank generally includes a rectangular, front panel 18 having a side edge 20 and a second, parallel side edge 22 which is continuously integrally connected to the side edge 22 of a first, rectangular side panel 24 about a fold line. The opposite, parallel side edge 25 of side panel 24 is free. The blank further includes a rectangular back panel 28 having a side edge 26 and a second, parallel side edge 30 continuously integrally connected to the side edge 30 of a second, rectangular side panel 32 about a fold line. The opposite, parallel side edge 20 of side panel 32 is continuously integrally connected to the side edge 20 of front panel 18 about a fold line. The side edge 26 of a glue flap 36 is continuously integrally connected to side edge 26 of back panel 28 about a fold line. Glue flap 36 in the most preferred form has the shape of an isosceles trapezoid with the major base extending along edge 26. Outer surface 17 of flap 36 can be secured to inner surface 19 of side panel 24 by any suitable means such as glue with edges 25 and 26 being coextensive with the glue flap 36 secured, edge 25 of panel 24 is continuously integrally connected to edge 26 of panel 28 about the fold line between panel 28 and glue flap 36. Panels 18, 24, 28, and 32 have equal heights and equal widths. In the preferred form, side panels 24 and 32 extend generally perpendicularly between panels 18 and 28 in the most preferred form to form a hollow rectangular parallelepiped, with panels 18, 24, 28, and 32 being arranged in a square configuration.

The bottom of carton 12 can be formed by any suitable manner and is flat. In the preferred form, side panels 24 and 32 include rectangular dust flaps 38 integrally extending from their bottom edges 40 about fold lines and having widths which are identical to side panels 24 and 32, with bottom edges 40 extending perpendicularly between edges 22 and 25 of panel 24 and between edges 20 and 30 of panel 32. Front and back panels 18 and 28 each include generally rectangular closure flaps 42 integrally extending from their bottom edges 44 about fold lines and having widths which are identical to panels 18 and 28, with bottom edges 44 extending perpendicularly between edges 20 and 22 of panel 18 and between edges 26 and 30 of panel 28. The lengths of flaps 38 and 42 from bottom edges 40 and 44 to their respective free edges are equal and preferably equal to one-half of the widths of panels 18, 24, 28 and 32. The side edges of flaps 38 and 42 are separated from each other. The bottom of carton 12 can then be formed by folding dust flaps 38 inwardly and generally perpendicular to side panels 24 and 32. Then one of the closure flaps 42 can be folded such that inner surface 19 thereof overlies at least portions of outer surfaces 17 of flaps 38. Thereafter, the other closure flap 42 can be folded such that inner surface 19 thereof overlies outer surfaces 17 of flaps 38. In the most preferred form, the free edges of flaps 38 abut and the free edges of flaps 42 abut when the bottom of carton 12 is formed and closed. The outer surfaces 17 of the inner flaps 38 can be secured to the inner surfaces 19 of the outer flaps 42 by any suitable means such as glue.

The top of carton 12 according to the teachings of the present invention can be formed by any suitable manner and is flat. In the preferred form, side panels 24 and 32 include rectangular dust flaps 46 integrally extending from their top edges 48 about fold lines and having widths which are identical to side panels 24 and 32, with top edges 48 extending perpendicularly between edges 22 and 25 of panel 24 and between edges 20 and 30 of panel 32. Front and back panels 18 and 28 each include generally rectangular closure flaps 50 integrally extending from their top edges 52 about fold lines and having widths which are identical to panels 18 and 28, with top edges 52 extending perpendicularly between edges 20 and 22 of panel 18 and between edges 26 and 30 of panel 28. The lengths of flaps 46 and 50 from top edges 48 and 52 to their respective free edges are equal and preferably equal to one-half of the widths of panels 18, 24, 28 and 32. The side edges of flaps 46 and 50 are separated from each other. The top of carton 12 can then be formed by folding flaps 46 inwardly and generally perpendicular to side panels 24 and 32. Then one of flaps 50 can be folded such that inner surface 19 thereof overlies at least portions of outer surfaces 17 of flaps 46. Thereafter, the other flap 50 can be folded such that inner surface 19 thereof overlies outer surfaces 17 of flaps 46. In the most preferred form, the free edges of flaps 46 abut and the free edges of flaps 50 abut when the top of carton 12 is formed and closed. The outer surfaces 17 of flaps 46 can be secured to the inner surfaces 19 of flaps 50 by any suitable means such as glue.

It should be noted that the fold lines between edges 20, 22, 26, 30, 40, 44, 48, and 52 in the most preferred form shown are formed by scoring the blank and particularly by linearly indenting outer surface 17 creating a concave channel depression therein and creating a convex linear projection in inner surface 19. It can be appreciated that fold lines can be formed in other manners such as by perforating the blank to a depth equal to or less than the thickness thereof, with the spacing between the perforations maintaining the continuous connection between panels 18, 24, 28, and 32 and with flaps 38, 42, 46, and 50.

Cartons 12 are typically stored in a collapsed tubular state before forming into package 10. Particularly, with outer surface 17 of glue flap 36 secured to inner surface 19 of panel 24 and in the collapsed, tubular state, panels 18 and 32 and panels 24 and 28 are generally planar, with the angles between edges 20 and edges 25 and 26 being 180° and the angles between edges 22 and 30 being 360°. Panels 18 and 32 underlie panels 24 and 28, respectively. To erect carton 12 from its collapsed state into a generally rectangular parallelepiped shape, edges 20, 22, 25, 26, and 30 are pivoted relative to each other, with panels 18 and 28 extending generally perpendicular to panels 24 and 32.

It can then be appreciated that the bottom of carton 12 formed by the securement of flaps 42 to inner flaps 38 closes and holds bottom edges 40 and 44 of panels 18, 24, 28, and 32, in the most preferred form, in a square configuration. Thus, the formed bottom of carton 12 holds carton 12 in the generally rectangular parallelepiped shape. Likewise, the top of carton 12 formed by securement of flaps 50 to flaps 46 closes and holds top edges 48 and 52 of panels 18, 24, 28, and 32, in the most preferred form, in a square configuration. Thus, the formed top of carton 12 also holds carton 12 in the generally rectangular parallelepiped shape.

Carton 12 as described thus far is of a conventional construction and does not form part of the present invention. It should be appreciated that carton 12 can have a variety of different types of construction other than as shown and described according to the teachings of the present invention.

Preferably, bowls 54 are formed from molded plastic and are discardable after use. Generally, bowls 54 include a generally circular bottom 56 having a diameter which is smaller than the widths of panels 18, 24, 28, and 32. Bowls 54 further include an open upper rim 58 having a generally cylindrical outer surface and defining the open upper end of bowls 54, with rim 58 having a diameter which is generally equal to but slightly smaller than the widths of panels 18, 24, 28, and 32 for slideable receipt therein. Bowls 54 further include a side 59 extending from rim 58 to bottom 56 of any suitable shape such as shown. Bowls 54 as described thus far are of a conventional construction and do not form part of the present invention. It should be appreciated that bowls 54 can have a variety of different types of construction other than as shown and described according to the teachings of the present invention.

Bowls 54 according to the preferred teachings of the present invention further include at least a first integral ear 60 extending radially from rim 58 and extending radially beyond the generally cylindrical outer surface thereof, with ear 60 being generally planar in the plane of rim 58. Ear 60 has a shape and size for receipt in the corner between front panel 18 and side panel 24 or 32 at edges 20 and 22. Bowls 54 further include a removable cover 62 having a shape corresponding to and for securement to rim 58 and ear 60 by any suitable means such as adhesive. It can then be appreciated that bowls 54 can be filled with a nonperishable food such as ready-to-eat cereal in the most preferred form and which is sealed therein by cover 62. Package 10 includes a multiple or plurality of bowls 54 and particularly six bowls in the most preferred form. In the most preferred form, covered bowls 54 are stacked in a stack having a height equal to a whole integer multiple of the individual height of bowls 54 from bottom 56 to cover 62, with the height of panels 18, 24, 28, and 32 being generally equal to but slightly more than the height of the stack of bowls 54 in the most preferred form.

Carton 12 according to the teachings of the present invention includes a removable tab 64 formed in panels 18, 24, and 32. In the most preferred form, tab 64 includes a perforated, linear line 66 extending between edges 20 and 22 generally parallel to edge 44 of panel 18 and spaced therefrom generally equal to but less than three times the height of bowls 54 from bottom 56 to cover 62. Tab 64 further includes a perforated, linear line 68 extending generally parallel to line 66 and to edge 44 of panel 18 and spaced from edge 44 slightly less than the height of bowl 54 and in the most preferred form about 5/6ths of the height of bowl 54. Line 68 is spaced intermediate edges 20 and 22 and in the preferred form has a length generally equal to ⅝ths of the width of panel 18. Tab 64 further includes first and second arcuate cut lines 70 extending from the opposite ends of line 66 to a point 90° therefrom onto panels 24 and 32 respectively. In the most preferred form, lines 70 have a radius of a length slightly more than one-half of the spacing of lines 66 and 68 and specifically approximately 60% in the most preferred form and of a length slightly more than the height of bowl 54 and substantially less than the width of panel 24 or 32. Tab 64 further includes first and second perforated, linear lines 72 formed in panels 24 and 32, respectively, extending from the opposite ends of lines 70 to edges 20 and 22, with lines 72 being parallel to and spaced from edges 40 of panels 24 and 32 and spaced from line 66 along the corners between panel 18 and panels 24 and 32 equal to the radius of lines 70. Lines 70 and 72 are spaced from the corners between back panel 28 and side panels 24 and 32. Tab 64 further includes first and second cut lines 74 formed in panel 18. In the most preferred form, lines 74 each include first, second and third linear portions. The first portions of lines 74 extend from edges 20 and 22 generally contiguous from the ends of lines 72 a short distance and specifically about 3.5% of the width of panel 18. The second portions of lines 74 extend at an obtuse angle in the order of 120° from the first portions of lines 74. The third portions of lines 74 extend generally continuously from the opposite ends of line 68 to and intersect with the second portions of lines 74. In the most preferred form, the interconnection between the first, second and third portions of lines 74 are arcuately formed. It can then be appreciated that lines 74 extend from line 68 to the corners between panel 18 and side panels 24 and 32 at points where lines 72 intersect therewith and which are spaced from edge 44 greater than the spacing of the interconnection of lines 74 with line 68 is from edge 44.

In the most preferred form, the cut portions of perforated lines 72 have a length generally equal to the uncut portions of perforated lines 72 and in the most preferred form generally equal to 0.0625 inch (0.15875 cm). The uncut portions of lines 66 and 68 have a length generally equal to the uncut portions of lines 72 while the cut portions of lines 66 and 68 have lengths substantially larger than the lengths of the uncut portions, with the cut portions of lines 66 and 68 having a length eight times of the uncut portions. Lines 70 and 74 generally do not include any uncut portions in the preferred form, and if uncut portions are provided, the cut portions of lines 70 and 74 have lengths which are substantially larger than the cut portions of lines 66 and 68.

Suitable provisions for holding carton 12 in a generally vertical condition can be provided. In the most preferred form, first and second, vertically spaced hook and loop fasteners 76 are utilized including first strips secured to outer surface 17 of panel 28 and the other strips having adhesive (covered by a removable covering) for adhering to a wall or like vertical surface such as a glass door of a refrigerated cooler. Although fasteners 76 have been shown and described in the most preferred form to be of the hook and loop type and are believed to be advantageous, other methods of quick and easy temporary attachment can be utilized according to the teachings of the present invention.

Now that the basic construction of package 10 according to the preferred teachings of the present invention has been explained, the preferred manner of use and subtle features of package 10 can be set forth and appreciated. Specifically, ready-to-eat cereal, snacks, or the like are filled into bowls 54 which are then sealed and covered by cover 62 by any suitable manner. Covered bowls 54 are then positioned and contained in carton 12. For example, carton 12 can be at least partially erected into a hollow parallelepiped shape and with at least one of the top and bottom being opened. The number of bowls 54 desired to be contained by carton 12 such as 6 in the most preferred form can be slideably inserted through the open end of carton 12, with bottoms 56 of bowls 54 resting upon covers 62 of the next bowl 54 in the stack of bowls 54. In the most preferred form, ear 60 of each bowl 54 is disposed in the corner between front panel 18 and side panel 24 or 32, with panels 18, 24, 28, and 32 generally abutting in a generally tangential manner with rims 58 of bowls 54. After insertion of bowls 54, the top and/or bottom of carton 12 can be closed such as in a manner previously set forth. It should be appreciated that tab 64 remains in carton 12.

Package 10 including carton 12 containing bowls 54 therein can then be stored and transported in a conventional manner. It should be appreciated that the spacing between the top and bottom of carton 12 or in other words the height of panels 18, 24, 28, and 32 should be generally equal to the combined height of the stack of bowls 54 to generally prevent movement of bowls 54 vertically in carton 12. Likewise, due to generally tangential abutment of panels 18, 24, 28, and 32 with rims 58, bowls 54 are also generally prevented from moving horizontally in carton 12. Furthermore, the distance that ears 60 radially extend from rims 58 and the placement of ears 60 in the corners of panels 18, 24, and 28 generally prevent rotation of bowls 54 about a vertical axis since ears 60 abut with and are unable to rotate past the portions of panels 18, 24, and 28 which generally tangentially abut with rims 58 of bowls 54 and which are located on either side of the corners into which ears 60 extend. Thus, bowls 54 are very securely contained inside of carton 12 and thus are not susceptible to damage due to handling and/or transport of package 10 according to the preferred teachings of the present invention.

When it is desired to merchandize the ready-to-eat cereal, store personnel remove tab 64 from panels 18, 24, and 32 to define a dispensing opening in carton 12. It should then be appreciated that the particular manner of forming tab 64 is advantageous. Particularly, the nonlinear portions of tab 64 namely lines 70 and 74 either do not include uncut portions or include widely spaced uncut portions to eliminate marring or other damage to the printed material on surface 17. Specifically, tearing of the printed material along paths outside of the perforated line are much more likely to occur in nonlinear lines than along linear lines. Further, it can be appreciated that due to the minimal size relative to the size of bowls 54 of the dispensing opening in panels 24 and 32 defined by lines 70 and 72, the remaining portions of panels 24 and 32 adjacent to the dispensing opening retain bowls 54 from moving horizontally generally parallel to panels 18 and 28 such that no or minimal force is placed upon the portions of tab 64 located in panels 24 and 32. However, bowls 54 can place considerable force against tab 64 when moving horizontally in carton 12 generally parallel to panels 24 and 32 towards panel 18. Due to the attachment by the uncut portions of lines 72 in panels 24 and 32, lines 66 and 68 are able to be perforated with substantially larger cut portions than uncut portions without problems associated from bowls 54 pushing against tab 64 in a direction parallel to panels 24 and 32. Thus, damage to the printed material on surface 17 of panel 18 is greatly minimized due to the linear nature and the long lengths of the cut portions of lines 66 and 68, and due to the generally cut nature of lines 74. Although perforated cuts 72 have equal length cut and uncut portions, damage to printed material on surface 17 of panels 24 and 32 is minimized due to the linear nature and relative short length of lines 72, with the generally cut nature of lines 70 greatly minimizing any damage to the printed material on surface 17 of panels 24 and 32. Although any damage to the printed material on surface 17 of carton 12 is undesirable from a marketing standpoint, such damage will be generally limited to side panels 24 and 32 according to the teachings of the present invention, which is more desirable from a merchandizing standpoint than front panel 18 which is usually more visually accessible.

After removal of tab 64 and assuming that strips of hook and loop fasteners 76 are not already attached to a wall or the like, package 10 can be installed in the following manner. Specifically, with both strips of fasteners 76 secured to panel 28 of carton 12, the adhesive coverings of fasteners 76 are removed and fasteners 76 with the adhesive adjacent the support wall are sandwiched between the wall and panel 28 of carton 12 by pushing carton 12 against the wall to adhere the adhesive to the wall. Thus, fasteners 76 hold package 10 including carton 12 containing bowls 54 to the wall. After all of bowls 54 have been removed from carton 12 such as in a manner set forth later, carton 12 can be pulled away from the wall to separate the first and second strips of fasteners 76, with one of the strips remaining attached to panel 28 and the other of the strips remaining adhesively attached to the wall. The empty carton 12 can then be suitably discarded preferably for recycling. A carton 12 including bowls 54 to be dispensed and including the complementary strips of fasteners 76 can then be attached to the strips of fasteners 76 adhesively attached to the wall. It can be appreciated that the strips of fasteners 76 can be scraped or otherwise removed without damaging the wall when it is no longer desired to merchandize ready-to-eat cereal and/or utilize package 10 according to the preferred teachings of the present invention.

It can then be appreciated that package 10 can be easily attached without the use of tools to any suitable vertical wall such as the door of or an adjacent wall to a refrigerated cooler for milk. Thus, package 10 according to the preferred teachings of the present invention can be positioned at locations which are conducive to impulse purchasing of food to be eaten on the run and so that valuable shelf space is not required. Thus, convenience stores, where shelf space is at a premium and quick selection and impulse purchasing are a norm, will find package 10 according to the teachings of the present invention to be an effective marketing tool.

It can then be appreciated that the lowermost bowl 54 in carton 12 is at least partially blocked by the portion of panel 18 below lines 68 and 74. The second lowest bowl 54 is then fully exposed and accessible through the dispensing opening while the third lowest bowl 54 is at least partially exposed through the dispensing opening in the most preferred form. One manner of removing the second bowl 54 through the dispensing opening would be for the customer to rotate the second bowl 54 until its ear 60 extends through the dispensing opening and beyond outer surface 17 of panel 18 such as by extending a finger through the portion of dispensing opening defined by lines 70 and 72 and pushing against ear 60. Ear 60 of the second bowl 54 can then be easily gripped such as between the thumb and forefinger and pulled to slide the second bowl 54 generally parallel to panels 24 and 32 from between the first and third bowls 54 and out of the dispensing opening. It can then be appreciated that the portion of panel 18 below lines 68 and 74 prevents the first bowl 54 from sliding out of the dispensing opening. Similarly, the portion of panel 18 above line 66 prevents the third bowl 54 from sliding out of the dispensing opening, with the consumer possibly also holding the third bowl 54 while the second bowl 54 is being removed.

It can be appreciated that after the second bowl 54 is slid from the stack of bowls 54 in carton 12, the remaining bowls 54 in carton 12 will fall under gravitational forces such that the prior third lowest bowl 54 becomes the second lowest bowl 54 and so forth. This process is repeated until only the lowest bowl 54 remains in carton 12. To remove the lowest bowl 54, the lowest bowl 54 could be rotated by pushing upon ear 60 to extend through the dispensing opening and beyond outer surface 17 of panel 18 in the same manner as prior bowls were rotated. Ear 60 of bowl 54 can then be easily gripped such as between the thumb and forefinger and raised until bottom 56 is positioned above line 68. At that time, bowl 54 can be pulled through the dispensing opening in a direction generally parallel to panels 24 and 32.

It can then be appreciated that tab 64 and the particular shape of the dispensing opening in carton 12 is particularly advantageous. First, the vertical spacing between lines 66 and 68 is relatively large and is particularly slightly smaller than twice the height of bowls 54. Thus, bowls 54 are readily visually and physically accessible. Visual accessibility is important so that the potential consumer can rapidly visualize the product and realize that the product can meet the consumer's needs and particularly can be eaten on the run. Physical accessibility is important so that the consumer can easily and rapidly remove the product without damaging the remaining product in carton 12 and without requiring assistance from store personnel. It can be appreciated that a dispensing opening only slightly larger than the product may have a tendency to bind on the product making its removal more difficult. Further, as set forth previously, the portions of tab 64 extending into panels 24 and 32 hold tab 64 from being forced horizontally outwardly and allow lines 66 and 68 to have elongated cut portions. In addition, the portions of the dispensing opening extending into panels 24 and 32 provide enhanced visual and physical accessibility. Specifically, as set forth previously, the finger of the consumer can be inserted into such portions for purposes of pushing or pulling ears 60 of bowls 54 to rotate them inside of carton 12 to expose ears 60 for ease of gripping. Further, it is not necessary for bowls 54 to be removed from the dispensing opening only in a straight line parallel to panels 24 and 32 but can be removed in directions skewed thereto and specifically partially through the portions of the dispensing opening extending into panels 24 and 32.

Furthermore, when tab 64 is first removed and carton 12 is held in a generally vertical condition such as by fasteners 76, it can be appreciated that considerable mass is placed upon and must be supported by the bottom of carton 12. With carton 12 formed of corrugated paperboard in the most preferred form, the portions of panel 18 below line 68 prevent the bottom of carton 12 from deflecting. It can then be appreciated that the portions of panel 18 to the sides of the second portions of lines 74 define braces adjacent to the corners between front panel 18 and side panels 24 and 32 to enhance the prevention of the bottom of carton 12 from deflecting due to the mass of bowls 54 contained therein. Due to the increase in strength in carton 12 due to the folds in the blank at edges 20 and 22, it can be appreciated that the braces defined by lines 74 extending from the corners between front panel 18 and side panels 24 and 32 are especially advantageous in the prevention of deflection.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Package comprising, in combination: a multiple of products to be dispensed, with each product having a height, with the products being stacked in a stack to have a height equal to a multiple of the heights of the products, with the product including at least a portion having a generally cylindrical outer surface of a diameter and having an ear extending radially beyond the cylindrical outer surface; and a dispenser including front, back, and first and second side panels having equal widths generally equal to but slightly larger than the diameter of the generally cylindrical outer surface and having equal heights at least equal to the height of the stack of products, with the panels of the dispenser being arranged in a configuration having corners to slideably receive the stack of products with the panels generally tangentially abutting with the cylindrical outer surfaces of the products and with the ears of the products extending into at least one of the corners between the panels, with the ears extending radially beyond the cylindrical outer surfaces to a distance to prevent rotation of the products within the dispenser due to the abutment of the ears with the panels on either side of the corners.

2. The package of claim 1 wherein the ears of the product extend into the corner between the front panel and one of the first and second side panels, with the dispenser including a removable tab defining a dispensing opening formed in at least the front panel allowing removal of an individual product from the stack of products, with the product being rotatable in the dispenser such that the ear of the individual product extends through the dispensing opening and beyond the front panel for allowing ease of removal of the individual product through the dispensing opening.

3. The package of claim 2 wherein the tab and the dispensing opening are further formed in at least one of the first and second panels spaced from the corner with the back panel, with the dispensing opening in the side panel providing access to the ear of the individual product for rotating the product in the dispenser.

4. The package of claim 1 wherein the front panel includes a bottom edge, with the dispenser including a removable tab defining a dispensing opening formed in at least the front panel allowing removal of an individual product from the stack of products, with the tab and the dispensing opening being spaced from the bottom edge, with the tab including a lower line spaced from the bottom edge and spaced from and intermediate the corners of the front panel and the first and second side panels, with the tab further including first and second front panel lines extending from the lower line to the corners between the front panel and the first and second side panels at points spaced from the bottom edge greater than the spacing of the interconnections of the first and second front panel lines to the lower line from the bottom edge, with the first and second front panel lines defining braces adjacent to the corners between the front panel and the first and second side panels to enhance the prevention of the deflection of the dispenser due to the products contained therein.

5. The package of claim 4 wherein the lower line is linear and parallel to the bottom edge of the front panel.

6. The package of claim 5 wherein the tab includes an upper line parallel to the lower line; wherein the tab is further formed in the first and second side panels by at least first side panel lines, with the first side panel lines, the lower line and the upper line being perforated including cut and uncut portions, with the cut portions of the lower and upper lines being substantially longer than the uncut portions.

7. The package of claim 6 wherein the cut portions of the first side panel lines have a length substantially equal to the uncut portions.

8. The package of claim 7 wherein the first side panel lines are linear and extend from the points at the corners of the first and second front panel lines generally parallel to the lower and upper lines.

9. The package of claim 8 wherein the tab is further formed in the first and second side panels by first and second arcuate lines extending from the upper line to the side panel lines spaced from the corners between the front and side panels, with the front panel lines and the arcuate lines being substantially cut.

10. The package of claim 9 wherein the arcuate lines have a radius, with the spacing of the points of the front panel lines from the upper line along the corners between the front and side panels being equal to the radius of the arcuate lines.

11. Dispenser for containing a multiple of products to be individually dispensed, with each product having a height, with the products being stacked in a stack to have a height equal to a multiple of the heights of the products, comprising, in combination: a front panel including a bottom edge; first and second side panels interconnected to the opposite sides of the front panel at first and second corners; and a dispensing opening formed in at least the front panel allowing removal of an individual product from the stack of products, with the dispensing opening including a lower line spaced from and intermediate the first and second corners of the front panel and the first and second side panels, with the dispensing opening further including first and second front panel lines extending from the lower line to the first and second corners between the front panel and the first and second side panels, respectively, at points spaced from the bottom edge greater than the spacing of the interconnections of the first and second front panel lines to the lower line from the bottom edge, with the first and second front panel lines defining braces adjacent to the first and second corners between the front panel and the first and second side panels to enhance the prevention of the deflection of the dispenser due to the products contained therein.

12. The dispenser of claim 11 wherein the lower line is linear and parallel to the bottom edge of the front panel.

13. The dispenser of claim 12 wherein the dispensing opening is spaced from the bottom edge, with the lower line being spaced from the bottom edge.

14. The dispenser of claim 13 wherein the dispensing opening includes an upper line parallel to the lower line; wherein the dispensing opening is further formed in the first and second side panels by at least first side panel lines; and wherein the dispensing opening is formed by a tab removable from the front and first and second side panels, with the first side panel lines, the lower line, and the upper line being perforated including cut and uncut portions, with the cut portions of the lower and upper lines being substantially longer than the uncut portions.

15. The dispenser of claim 14 wherein the cut portions of the first side panel lines have a length substantially equal to the uncut portions.

16. The dispenser of claim 15 wherein the first side panel lines are linear and extend from the points at the corners of the first and second front panel lines generally parallel to the lower and upper lines.

17. The dispenser of claim 16 wherein the tab is further formed in the first and second side panels by first and second arcuate lines extending from the upper line to the side panel lines spaced from the corners between the front and side panels, with the front panel lines and the arcuate lines being substantially cut.

18. The dispenser of claim 17 wherein the arcuate lines have a radius, with the spacing of the points of the front panel lines from the upper line along the corners between the front and side panels being equal to the radius of the arcuate lines.

19. Dispenser for containing a multiple of products to be individually dispensed, with each product having a height, with the products being stacked in a stack to have a height equal to a multiple of the heights of the products, comprising, in combination: a front panel including a bottom edge; first and second side panels interconnected to the opposite sides of the front panel at first and second corners; and a removable tab defining a dispensing opening formed in the front panel and the first and second side panels allowing removal of an individual product from the stack of products, with the tab including a lower line formed in the front panel, an upper line formed in the front panel spaced from and parallel to the lower line, and at least first side panel lines formed in the first and second side panels, with the lower and upper lines being linear and parallel to the bottom edge of the front panel, with the first side panel lines, the lower line and the upper line being perforated including cut and uncut portions, with the cut portions of the lower and upper lines being substantially longer than the uncut portions; wherein the tab and the dispensing opening are spaced from the bottom edge, with the lower line being spaced from the bottom edge and spaced from and intermediate the corners of the front panel and the first and second side panels, with the tab further including first and second front panel lines extending from the lower line to the corners between the front panel and the first and second side panels at points spaced from the bottom edge greater than the spacing of the interconnections of the first and second front panel lines to the lower line from the bottom edge.

20. The dispenser of claim 19 wherein the cut portions of the first side panel lines have a length substantially equal to the uncut portions.

21. The dispenser of claim 19 wherein the first side panel lines are linear and extend from the points at the corners of the first and second front panel lines generally parallel to the lower and upper lines.

22. The dispenser of claim 21 wherein the tab is further formed in the first and second side panels by first and second arcuate lines extending from the upper line to the side panel lines spaced from the corners between the front and side panels, with the front panel lines and the arcuate lines being substantially cut.

23. The dispenser of claim 22 wherein the arcuate lines have a radius, with the spacing along the first and second corners between the front panel lines and the upper line being equal to the radius of the arcuate lines.

24. Dispenser for containing a multiple of products to be individually dispensed, with each product having a height, with the products being stacked in a stack to have a height equal to a multiple of the heights of the products, comprising, in combination: a front panel including a bottom edge; first and second side panels interconnected to the opposite sides of the front panel at first and second corners; and a removable tab defining a dispensing opening formed in the front panel and the first and second side panels allowing removal of an individual product from the stack of products, with the tab including a lower line formed in the front panel, an upper line formed in the front panel spaced from and parallel to the lower line, and first and second side panel lines formed in each of the first and second side panels, with the lower and upper lines being linear and parallel to the bottom edge of the front panel, with the first side panel lines being linear and extending from the first and second corners generally parallel to the lower and upper lines, with the second side panel lines being arcuate and extending from the upper line to the first side panel lines spaced from the first and second corners, with the second side panel lines being substantially cut, with the first side panel lines, the lower line and the upper line being perforated including cut and uncut portions.

25. The dispenser of claim 24 wherein the second side panel lines have a radius, with the spacing along the first and second corners between the upper line and the first side panel lines being equal to the radius of the arcuate lines.

* * * * *